US012611581B2

(12) United States Patent
Weding

(10) Patent No.: US 12,611,581 B2
(45) Date of Patent: Apr. 28, 2026

(54) WEIGHTED FLYING DISC ATTACHMENT

(71) Applicant: Hans Dieter Weding, Mission, KS (US)

(72) Inventor: Hans Dieter Weding, Mission, KS (US)

( * ) Notice: Subject to any disclaimer, the term of this patent is extended or adjusted under 35 U.S.C. 154(b) by 866 days.

(21) Appl. No.: 17/820,403

(22) Filed: Aug. 17, 2022

(65) Prior Publication Data

US 2023/0059071 A1 Feb. 23, 2023

Related U.S. Application Data

(60) Provisional application No. 63/234,692, filed on Aug. 18, 2021.

(51) Int. Cl.
*A63B 65/10* (2006.01)
*A63B 67/06* (2006.01)

(52) U.S. Cl.
CPC ..... *A63B 65/10* (2013.01); *A63B 67/06* (2013.01)

(58) Field of Classification Search
CPC ..... A63B 65/10; A63B 67/06; A63B 2225/30; A63B 2225/68
See application file for complete search history.

(56) References Cited

U.S. PATENT DOCUMENTS 2,173,010 A 9/1939 De Amario
4,005,864 A 2/1977 Steward
4,132,030 A 1/1979 Lehman
4,377,282 A 3/1983 Hayes
4,410,115 A 10/1983 McClain, Jr. et al.
4,453,656 A 6/1984 Gillum
4,538,812 A 9/1985 Mugford et al.
4,940,441 A 7/1990 Novinsky
5,050,877 A 9/1991 Wales
5,178,394 A 1/1993 Tanampai
5,282,634 A * 2/1994 Chamberland ..... A63B 59/30 81/418
5,460,378 A 10/1995 Getts
6,599,201 B1 7/2003 Grant
6,866,592 B1 3/2005 Gitre
9,555,281 B2 1/2017 Beckman
9,694,237 B2 * 7/2017 Palmenco-Geller ..... A63B 21/065
10,188,893 B2 1/2019 Johnson et al.
10,269,263 B2 4/2019 Carrick
2002/0128085 A1 9/2002 Kallassy
2003/0005797 A1 1/2003 Hopper et al.
2008/0146384 A1 6/2008 Hansen et al.
(Continued)

OTHER PUBLICATIONS https://www.thingiverse.com/thing:4914221 (Year: 2021).*
(Continued)

*Primary Examiner* — Jeffrey S Vanderveen
(74) *Attorney, Agent, or Firm* — AVEK IP, LLC

(57) ABSTRACT

A flying disc attachment comprises an upper piece and a lower piece, with a hinge mechanism connecting the upper piece to the lower piece. The hinge mechanism is operable to facilitate movement of the upper piece with respect to the lower piece while biasing the upper piece with respect to the lower piece. One or more weights are attached to at least one of the upper piece and the lower piece, and a grip is coupled to at least one of the upper piece and the lower piece, the grip comprising a slip-resistant material and configured to engage a surface of a flying disc.

29 Claims, 8 Drawing Sheets

(56) References Cited

U.S. PATENT DOCUMENTS

| | | | |
|---|---|---|---|
| 2015/0219130 | A1 | 8/2015 | Killion et al. |
| 2016/0101335 | A1 | 4/2016 | Lam |
| 2018/0087714 | A1 | 3/2018 | Goffman |

OTHER PUBLICATIONS

Discmania; 5 Tips for an Effective Tournatment Warmup Routine, https://www.discmania.net/blogs/discover/5-tips-for-an-effective-tournament-warmup-routine; Oct. 6, 2017.

* cited by examiner

WEIGHTED FLYING DISC ATTACHMENT

CROSS-REFERENCE TO RELATED APPLICATIONS

This application claims priority to U.S. Provisional Patent Application Ser. No. 63/234,692, filed on Aug. 18, 2021, entitled "FLYING DISC ATTACHMENT INCLUDING INTERCHANGEABLE WEIGHTS", the entire disclosure of which is incorporated herein by reference.

FIELD

The invention relates generally to training aids for recreational flying discs, and more specifically to a weighted attachment for flying discs.

BACKGROUND

The use of a flying disc for recreation or sport began as early as 1871. In 1948, the flying disc changed in composition from tin to a more user-friendly plastic. Flying discs began to be mass produced in 1974, which spawned many organized sporting activities including Disc Golf and Ultimate. Using Disc Golf as an activity of focus, disc golfers utilize a flying disc to throw from a given point and advance the flying disc to an entrapment device, commonly referred to as a basket that catches the disc. Disc Golf is very similar to traditional Golf in method and scoring, with the biggest difference being the use of a flying disc and basket versus a ball and a hole.

Professional and amateur athletes alike, train in their related sport to maximize personal performance. Using the sport of Baseball as an example, a baseball player has the ability to warm up, stretch out, and prime muscles relevant to swinging a bat on demand. The baseball player utilizes a ring weight or sleeve weight that attaches to a bat. The player swings the weighted bat in the on-deck circle preparing for a plate appearance. Along with muscle preparation, an increase in bat speed is perceived when the weight is removed from the bat prior to the bat being in play. Using traditional Golf as another example, a ring weight or sleeve weight can be attached to the player's golf club for the purpose of preparing relevant muscles for the activity of hitting a golf ball. The weight is removed from the club before the golf club is used to strike the ball. The golfer benefits in the same way as the previously mentioned baseball player.

Referring now to the sport of Disc Golf, disc golfers are no exception to the need for stretching out and warming up relevant muscles that relate to the throwing of a flying disc. The ring weight or sleeve weight that a baseball player or a ball golfer use is not feasible to use with a flying disc. Disc golfers find themselves with the unique opportunity to stretch and prime muscles related to the throwing motion on demand.

The FlighTowel, a product of FlighTowel, LLC located in Turner, Oregon, is a towel attached to a small piece of the rim of a flying disc and the ProPull System, a product of ProPull Disc Golf located in Charlotte, North Carolina, utilizes rubber bands with a practice disc. Both products are training aids configured to help the disc golfer stretch, warm, and prime muscles. But, because these products use either a moving towel's air resistance or a stretch band's elasticity to provide resistance to the thrower, they do not emulate the resistance felt by a thrower with particular accuracy and are difficult to adjust without replacing the resistance device.

A need therefore exists for an improved flying disc exercise apparatus as may be used to warm up, build strength, and prevent injury while engaging in flying disc sports.

SUMMARY

One example embodiment comprises a flying disc attachment having an upper clamp member and a lower clamp member, with a hinge mechanism connecting the upper clamp member to the lower clamp member. The hinge mechanism is operable to facilitate movement of the upper clamp member with respect to the lower clamp member while biasing the upper clamp member with respect to the lower clamp member. One or both of the clamp members may be weighted. In one embodiment, one or more weights are attached to at least one of the upper clamp member and the lower clamp member, and a grip is coupled to at least one of the upper clamp member and the lower clamp member, the grip comprising a slip-resistant material and configured to engage a surface of a flying disc and preferably the flight plate of the flying disc.

In one embodiment, the first clamp member includes a first grip head, a first neck portion, a first hinge portion and a first handle. The first neck portion connects the first grip head to the first hinge portion. The second clamp member includes a second grip head, a second neck portion, a second hinge portion and a second handle. The second neck portion connects the second grip head to the second hinge portion. Grip pads extend across or are formed on inner faces of the first and second grip heads. The first hinge portion is pivotally connected to the second hinge portion such that the first grip head and the first neck portion connected thereto are pivotable about the hinge axis and relative to the second grip head and the second neck portion connected thereto. A spring on the flying disc attachment and positioned to engage the first and second clamp members normally biases the first grip head toward the second grip head. The first and second handles are engageable by a user to pivot the first grip head and first neck portion connected thereto against a biasing force of the spring, about the hinge axis and away from the second grip head and second neck portion connected thereto. One or both of the first and second neck portions project or curve outward from a plane extending between the first grip head and the second grip head when biased together to form a relief space between first and second neck portions. The relief space is sized to receive a depending rim of the flying disc when the first and second grip heads are clamped onto the flight plate of the flying disc.

In another example, a method of using a flying disc attachment is disclosed. More specifically the novel method includes attaching a removable flying disc attachment to a flying disc by causing an upper clamp member and a lower clamp member of the flying disc attachment to grip a portion of the flying disc. One or both of the clamp members may be weighted by for example attaching one or more weights to one or both of the clamp members.

The details of one or more examples are set forth in the accompanying drawings and the description below. Other features and advantages will be apparent from the description and drawings, and from the claims.

DETAILED DESCRIPTION

Figure 1:
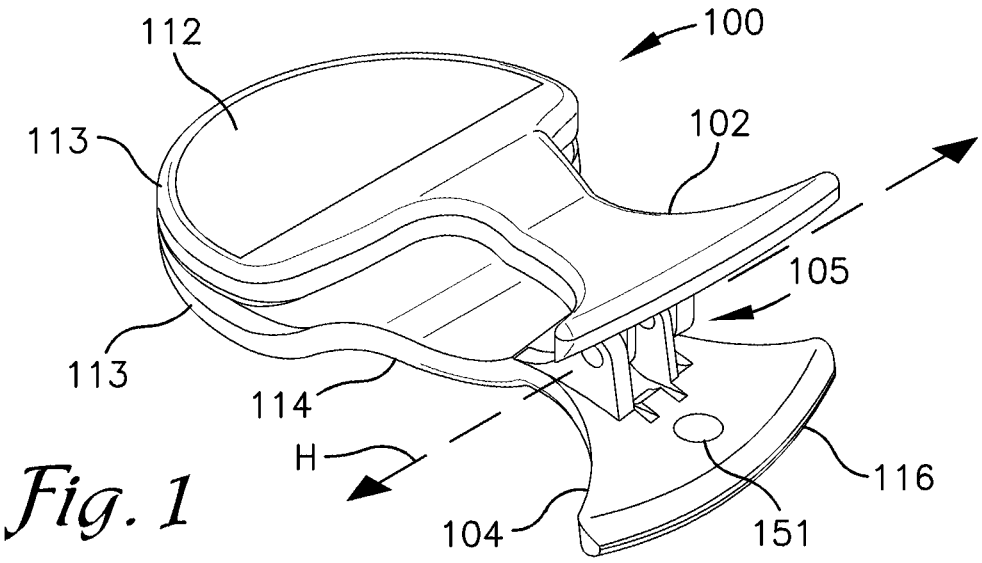
FIG. 1 is a perspective view of an embodiment of weighted flying disc attachment that can be attached to a flying disc and showing grip portions of the attachment spring biased to a closed position.
Figure 2:
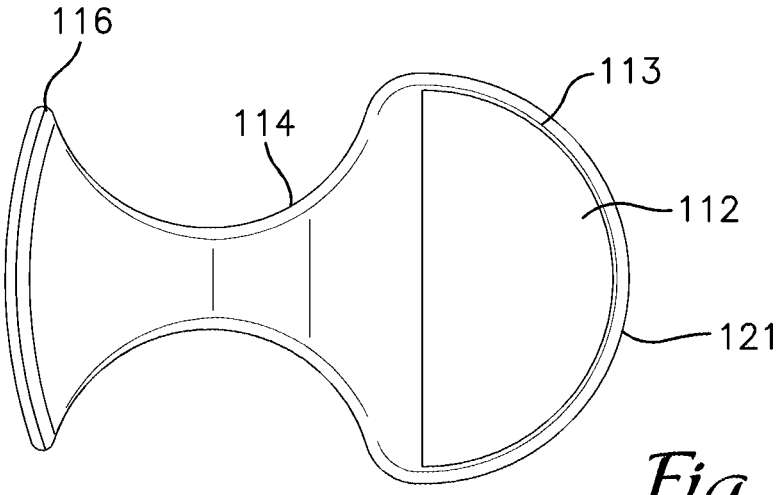
FIG. 2 is a top plan view of the attachment shown in FIG. 1.
Figure 3:
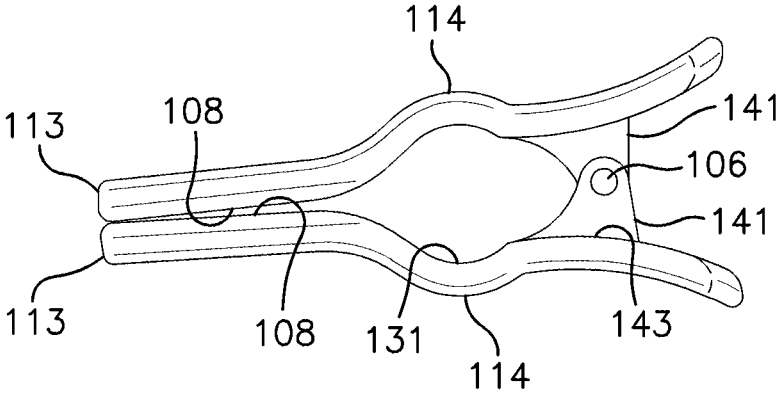
FIG. 3 is a left, side elevational view of the embodiment in FIG. 1.

In the following detailed description of example embodiments, reference is made to specific example embodiments by way of drawings and illustrations. These examples are described in sufficient detail to enable those skilled in the art to practice what is described and serve to illustrate how elements of these examples may be applied to various purposes or embodiments. Other embodiments exist, and logical, mechanical, electrical, and other changes may be made. Features or limitations of various embodiments described herein, however important to the example embodiments in which they are incorporated, do not limit other embodiments, and any reference to the elements, operation, and application of the examples serve only to define these example embodiments. Features or elements shown in various examples described herein can be combined in ways other than shown in the examples, and any such combinations is explicitly contemplated to be within the scope of the examples presented here. The following detailed description does not, therefore, limit the scope of what is claimed. It is important to note that while not shown in detail, the concept of the embodiment including a safety latch being included to maintain attachment and its components in place.

Recreational flying discs have been used for over 150 years as a toy, as a form of entertainment, and for exercise. Flying discs are often referred to as Frisbees, which is a brand name of the Wham-O corporation, which popularized the toy in the middle of the $20^{th}$ century. A typical flying disc 22 comprises a round, and slightly domed flight plate 24 with a pronounced lip or rim 26 at the outer circumference. The shape of the disc forms an airfoil that enhances flight by reducing draft and increasing lift as the thrown disc flies through the air, and spinning the thrown disc stabilizes the disc using gyroscopic force. The pronounced lip or rim 26 at the edge of the disc 22 provides both an area for a user to grip and throw the disc and increases the rotational momentum of a thrown disc for enhanced accuracy and distance. The flight plate 24 is of generally thin-walled construction and includes upper and lower surfaces 28 and 29.

Flying discs used for backyard recreation are often 10-12 inches in diameter and made of molded plastic. Specialty discs for various special purpose activities include dog discs designed for dogs to catch that are relatively slow-flying and made of a pliable material to resist dog bites and injuries to dogs, and disc golf discs that are relatively heavy and small with a beveled lip designed for enhanced distance and accuracy in a variety of wind conditions. Other activities such as Ultimate are played with a standard flying disc, in which two opposing teams try to advance the disc across the opponent's goal line by passing the disc from player to player (a player holding the disc may not run to advance the disc). This invention is believed to have particular appeal in the rapidly growing and popular sport of disc golf.

Many such sports are very physical in nature and require a disc thrower to throw with both power and accuracy, which can lead to injuries such as pulled muscles, strains, sprains, and the like. As with many sports, flying disc enthusiasts also work to build strength and agility in the motions involved with throwing the disc, and may seek exercises that strengthen the muscles and mimic the motions involved with disc sports. For example, a disc thrower's shoulders and triceps must contract to lift and extend the throwing arm. Similarly, the forearm, wrist and hand muscles contract to hold and release the disc, and stretch as the thrower extends and releases the disc. Further, many flying disc participants rely on muscle memory built while learning to play the sport to intuitively know how various disc throwing motions should feel, and to correct flaws in their throwing technique. However, as in most sports exercise and conditioning is often necessary to improve and maintain the skill.

Concerns such as these can be addressed by some products available on the market such as the FlighTowel, a product of FlighTowel, LLC located in Turner, Oregon, which is a towel attached to a small piece of a rim of a flying disc, and the ProPull System, a product of ProPull Disc Golf located in Charlotte, North Carolina, which utilizes rubber bands with a practice disc. These products use either a towel or a stretch band to provide resistance to a disc thrower's motions while warming up, with the FlighTowel doubling as a towel for cleaning disc golf discs.

But, the FlighTowel uses the towel's air resistance to provide resistance to the thrower when moving, which changes significantly with the speed at which the thrower moves the apparatus through the air. The ProPull system uses elastic bands, which provide greater resistance when stretched to greater distances such that the resistance provided doesn't mimic the throwing motion particularly well and full range of motion may be difficult to achieve.

Some examples described herein therefore provide a flying disc apparatus having a weight cavity configured to securely hold a weight (which in a further example is user-configurable), enabling the disc to respond as a normal disc to various throwing motions while providing a greater-than-normal resistance to the thrower and improving muscle memory feedback. In a more detailed example, an apparatus has a cavity into which either a fixed weight or a user-selectable weight is inserted, and the apparatus is removably attached to a flying disc such as by using a spring-loaded clamping element. The spring-loaded clamping element in a further example comprises two clamping surfaces that when clamping a flying disc are approximately coplanar and engage opposite sides (e.g., the top and the bottom) of a flight plate portion of a flying disc. In another example, the apparatus forms a neck area providing rim clearance when in the clamped position, preventing the rim of a flying disc from interfering with the clamping motion of the apparatus and allowing the apparatus to securely engage the flying disc's flight plate from both sides.

FIGS. 1-5 show multiple views of a weighted flying disc attachment that can be attached to a flying disc 22, consistent with an exemplary embodiment. The flying disc attachment 100 shown in FIGS. 1-6 includes an upper portion 102, and lower portion 104 connected to each other by hinge assembly 105. Upper and lower portions 104 may also be referred to upper and lower clamp members 102 and 104. A layer of non-slip material or grip portion 108 is attached to or otherwise formed on each of the upper and lower portions 102 and 104. One or more weighted bodies, inserts of relatively dense material or weights 109 are secured within a weight receiving cavity 110 formed in each of the upper and lower portions 102 and 104. A lid 112 is secured across the weight receiving cavity 110 in each of the upper and lower portions 102 and 104 to secure the weight or weights 109 therein. The hinge assembly in this example allows the upper portion 102 to move with respect to the lower portion 104 about a hinge axis H. The hinge assembly 105 shown further comprises one or more hinge pins 106 and a spring element 147, such as a torsion spring, helical spring, leaf spring, banjo clip, an elastomer, or other such biasing spring element that biases upper portion 102 with respect to lower portion 104.

Upper and lower portions 102 and 104 are preferably formed from a relatively rigid material such as a rigid, molded plastic and may be configured identically to allow each portion 102 and 104 to be molded as a single part from a common mold cavity. The plastic utilized to form the clamp member body 211 may be one or more of polyethylene (PE), polypropylene (PP), polyethylene terephthalate (PETE), polyvinyl chloride (PVC), and acrylonitrile-butadiene-styrene (ABS) or other suitable plastics or plastic blends. Upper portion 102 and lower portion 104 each include a flight plate engaging member 113 or grip head 113, a neck or neck portion 114, a hinge section 115 and a handle portion 116.

In the embodiment shown, the grip head 113 of the upper and lower portions 102 and 104 is generally D-shaped and enlarged relative to the neck 114. An outer, peripheral edge 121 of each grip head 113 is rounded or curved. In the embodiment shown in FIGS. 1-6 an inner face 125 of each grip head 113 is generally planar and faces an inner face 125 of the opposite upper and lower portion 102 or 104 when the upper and lower portions 102 and 104 are hingedly connected together by hinge pin 218. In the embodiment shown, grip portions 108 are adhered to the inner face 125 of the grip head 113 of each of the upper and lower portions 102 and 104. The grip portions 108 are configured to grip a flight plate 24 or fight plate portion 24 of a flying disc 22 when the flying disc attachment 100 is attached thereto. The grip portions 108 in various examples comprises a layer of non-slip or slip resistant material having an outer facing surface or grip surface 127 configured or textured or having properties including resiliency adapted to grip a face of the flight plate 24 of a flying disc 22 more strongly than a conventional plastic material. Accordingly, the grip portions 108 could be made of rubber, gum rubber, silicone, foam, cork, a textured surface, or an abrasive surface. Dycem™ brand non-slip materials have been found to be an effective material for use in forming the grip portions 108. It is foreseen that the upper and lower portions 102 and 104 of the attachment 100 or just the portion of the grip heads 113 forming the inner faces 125 thereof could be formed from a material have sufficient non-slip properties or resiliency to eliminate the need for a separate layer of non-slip material.

The weight cavity 110 is formed in each grip head 113 on a side opposite the inner face 125 and grip portion 108 and covered by the lid 112 extending across the cavity 110. In some examples the user can open and close the lid 112, such as by snapping the lid into place or selectively affixing and removing the lid with fasteners such as screws. Such a configuration enables the user to insert a user-selectable weight 109 (see FIG. 5) into the cavity 110, such as heavier or lighter weights for different users, for different purposes, or for use with different flying discs. Weights 109 in various embodiments may be formed from steel, tungsten, brass, plastic, or other suitable material. In another example, a weight 109 inserted into cavity 110 is fixed such as by gluing or otherwise permanently fixing weight 109 to lid 112 in cavity 110. In other embodiments, one or more weights are positioned elsewhere on the flying disc attachment 100, such as on a handle portion 116 of the flying disc attachment 100.

Some examples of flying discs as may be used with the embodiment of the flying disc attachment 100 of FIGS. 1-6 have a flight plate 24 which is generally horizontally flat or slightly domed, with the rim 26 extending below the flight plate 24. The neck portion 114 of each of the upper body portion 102 and lower body portion 104 are configured to cooperatively avoid the rim 26, providing an opening or relief 131 when the flying disc attachment 100 is in the closed position to accommodate and protect a flying disc rim 26 such that the rim 26 does not engage with the neck portion 114 and prevent the grips 108 from engaging the flight plate of the flying disc. In another example, the neck portion 114 of the lower body portion 104 engages some portion of the rim 26, such as to keep the flying disc attachment 100 from slipping off the flying disc 22 while allowing the flying disc attachment 100 to close and securely grip the flying disc 22. The neck portion 114 in some examples is configured to provide a relief 131 configured to fit a specific model or type of flying disc 22 associated with the flying disc attachment 100, or is designed to accommodate a wide range of commercially available flying discs 22.

Figure 4:
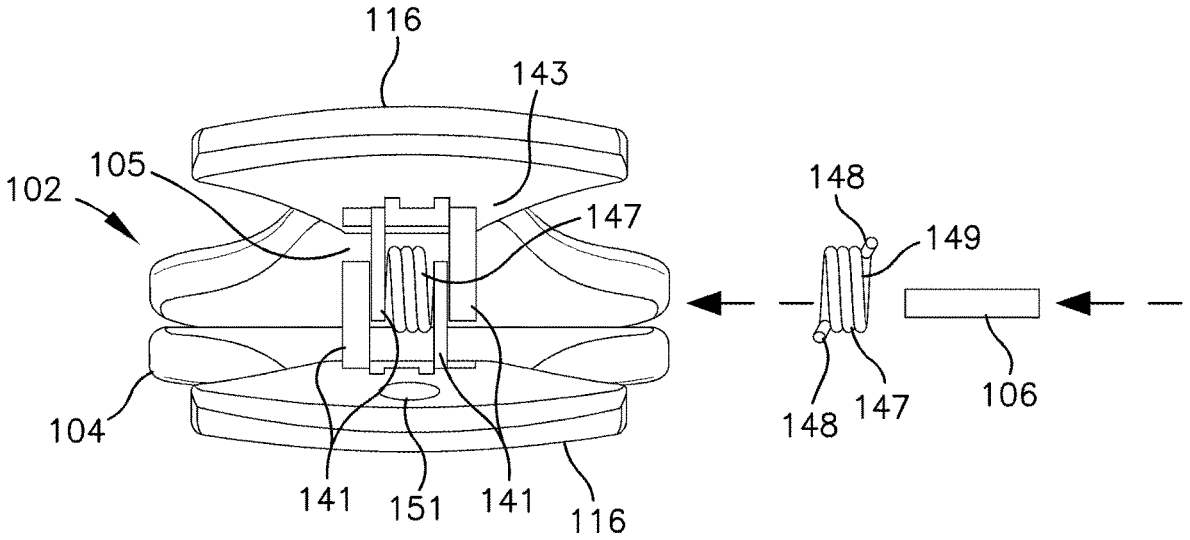
FIG. 4 is a rear elevational view of the embodiment shown in FIG. 1.
Figure 5:
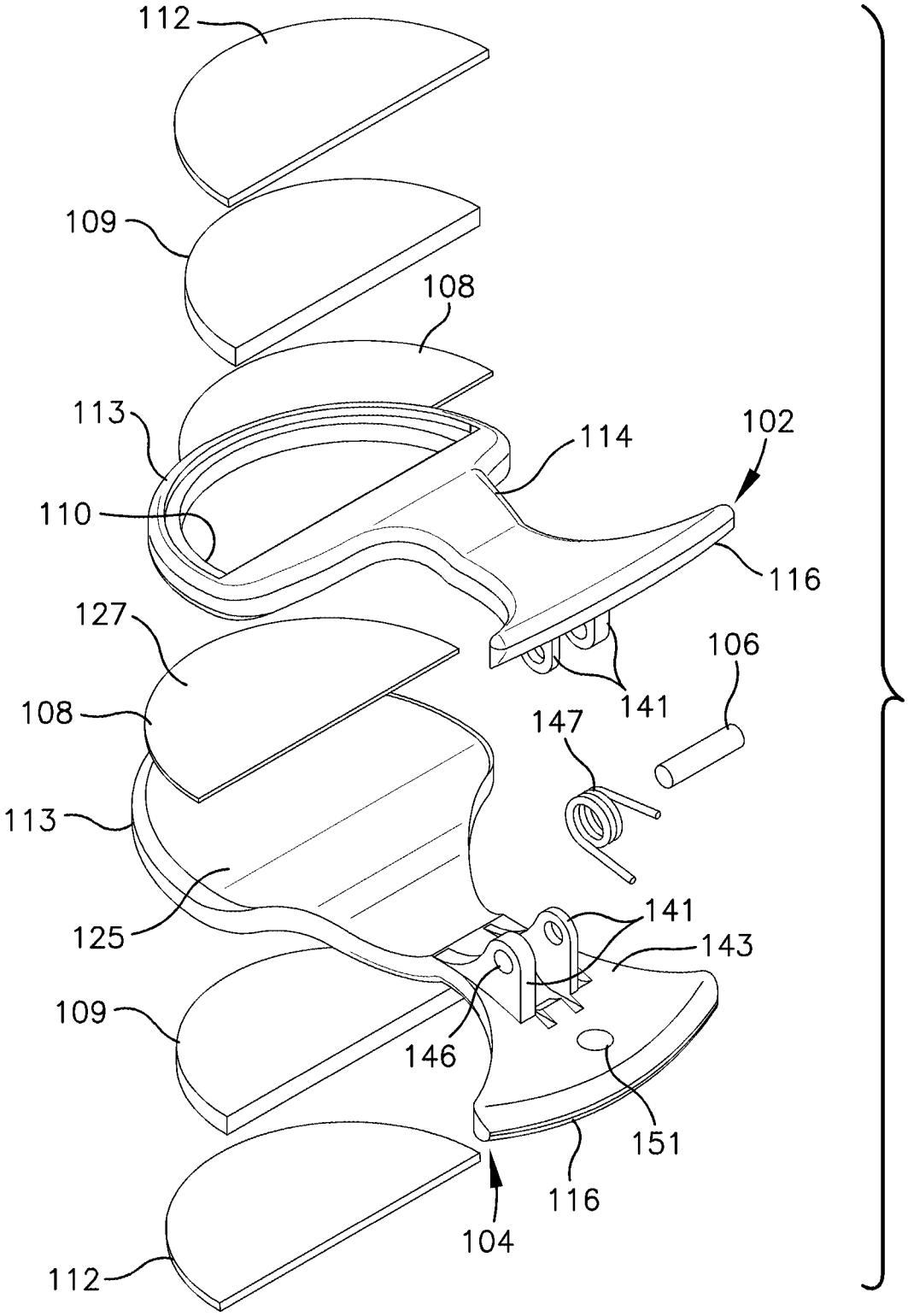
FIG. 5 is an exploded view of the embodiment shown in FIGS. 1-4 showing textured surfaces and weights securable to the grip portions of the attachment.

The hinge assembly 105 of the flying disc attachment in this example is formed by overlapping pairs of hinge lobes or knuckles 141 formed on and projecting inward from an inner surface 143 of the hinge section 115 of each of the upper and lower body portions 102 and 104 connected together by hinge pin 106 extending through aligned holes 146 formed though the hinge lobes 141. At least one of the upper portion 102 and lower portion 104 are free to rotate about the pin 106, enabling the upper and lower portions 102 and 104 to move or pivot with respect to one another about the axis (hinge axis H) of the pin 106. In a further example, the hinge assembly 105 includes a biasing member, such as the spring mechanism 147 formed from a coiled spring wire with ends of the wire forming biasing elements or legs 148 projecting outward from a coiled section 149 of the spring wire at an acute angle. As shown in FIGS. 4 and 5, the spring mechanism 147 is positioned between adjacent sets of aligned hinge lobes 141 with the hinge pin 106 extending through the coiled section 149 of the spring wire and the legs 148 of the spring mechanism 147 engaging an inner face of a respective hinge section 115 or handle portion 116 of the upper and lower body portions 102 and 104 rearward of the hinge pin 106 to normally bias the inner face 125 of each of the grip heads 113 toward each other. The spring mechanism 147 is captured in place by the hinge pin 106 running through the aligned holes 146 in both sets of overlapping hinge lobes 141 projecting inward from an inner surface of the hinge section 115 of each of the upper and lower portions 102 and 104. In other examples, the hinge assembly 105 comprises a spring mechanism such as a leaf or torsion spring physically linking the upper and lower portions 102 and 104 of the flying disc attachment 100 together.

The handle portion or handle end 116 of each of the upper and lower portions 102 and 104 of the flying disc attachment 100 comprises a region configured to be pinched, squeezed, compressed or pressed together to overcome the biasing force of the spring mechanism 147, and to pivot the grip heads 113 away from each other to cause separation of the grip heads 113 of the upper and lower portions 102 and 104 of the flying disc attachment 100. This facilitates attaching and detaching the flying disc attachment 100 to a flying disc. The handle portion 116 of each of the upper and lower portions 102 and 104 is flared outward from an inner surface of the upper and lower portions 102 and 104 and is formed wider than the neck portion 114 to facilitate gripping and squeezing the handle portions 116 toward each other. The handle portion 116 in a further example includes a hole or opening 151 configured to accommodate an accessory such as a tether (or towel holder) that can be placed around a user's wrist to secure the flying disc attachment 100 to the user when in use. In another embodiment, the size of handle portion 116 is configured to limit protrusion from a flying disc 22 when the flying disc attachment 100 is attached to the flying disc 22, and/or is contoured to generally follow the curved shape of flying disc 22. It is foreseen that one or more handles could be formed on the grip heads 113 instead of on a side of the hinge assembly 105 opposite the grip heads 113 so as to reduce the portion of the attachment 100 projecting outward from a flying disc 22 to which the attachment 100 is attached.

In some further examples, the flying disc attachment 100 includes one or more training aids, such as a bubble level or an electronic level that are operable to indicate whether the flying disc attachment (and an attached flying disc) are being held level. In a more complex example, one or more indications of speed, force, or other motion characteristic are provided by the flying disc attachment, such as via an electronic sensor and a Liquid Crystal Display (LCD) when the flying disc attachment is used to warm up, stretch, or exercise with the flying disc attachment attached to a flying disc.

FIG. 5 shows an exploded view of the embodiment of the flying disc attachment 100 of FIGS. 1-4. As shown in FIG. 5, the grip portion 108 of the upper and lower portions 102 and 104 are shown separate from other elements in the exploded view provided but are affixed in assembly of the flying disc attachment 100 to the upper portion 102 and lower portion 104 such as by an adhesive. The grip portions 108 or gripping layers 108 are operable when the flying disc attachment 100 is assembled and in use to grip the flight plate 24 of a flying disc 22. The grip portions 108 in various examples comprise a textured (preferably non-slip) surface, a rubber or rubberized surface, or similar materials such as silicone, cork, or foam that provide a greater coefficient of friction between the flying disc apparatus and the flight plate of a flying disc than the material used to form the upper and lower portions 102 and 104 (such as a hard plastic).

In FIG. 5, the weight 109 associated with each grip head 113 is shown as a single weighted body 109 retained in the cavity 110 of the grip head 113 by a respective cover or lid 112, which in various examples may be removably snapped or screwed into place or are permanently affixed such as by use of an adhesive or plastic welding, such as ultrasonic or infrared plastic welding. The weights 109 in various examples therefore may be permanently or removably attached, and in other examples are located elsewhere on the flying disc attachment 100 and/or are attached via other means.

In some such examples, the weights 109 are removeable and can be replaced with one or more different weights 109, such that a user can configure the amount of weight carried by the flying disc assembly. This enables the user to customize the amount of weight 109 used in warming up, stretching, or exercising using the flying disc attachment 100 attached to a flying disc 22. The weights in various examples are formed from any suitable material providing the desired mass or weight, including brass, iron, steel, tungsten, lead, or other metals, as well as ceramics, plastics, and other materials that may also be used in conjunction with a metal such as plastic-encapsulated lead weights.

Figure 6:
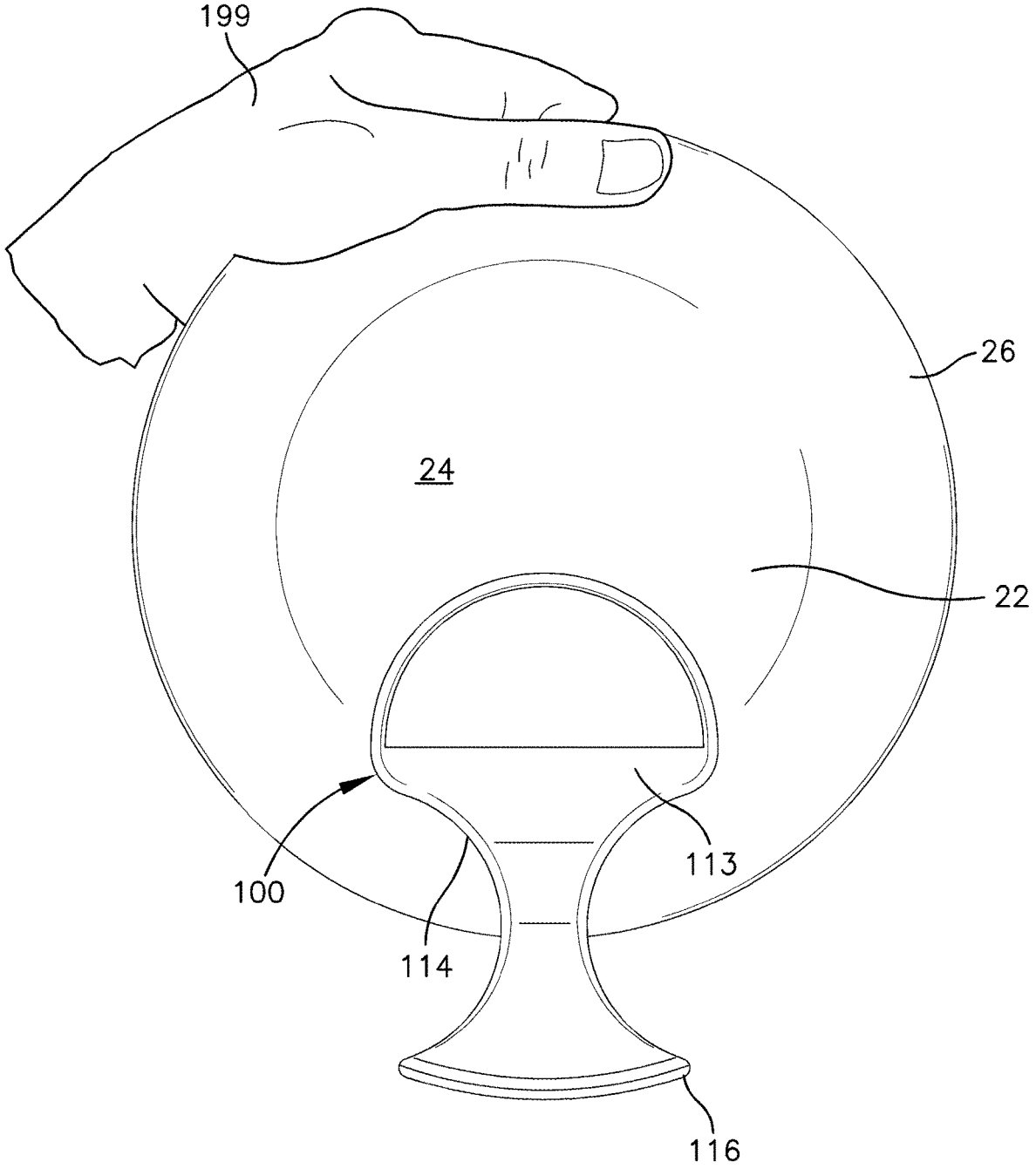
FIG. 6 is a top plan view showing the weighted flying disc attachment attached to a flying golf disc held in the hand of a user.

FIG. 6 shows the flying disc attachment 100 with user-configurable weights 109 attached to a flying disc, consistent with the embodiment disclosed in FIGS. 1-5. The flying disc attachment 100 is shown attached to a flying disc 22, such that the grip portions 108 of the upper and lower pieces 102 and 104 of the flying disc attachment 100 are biased against the flight plate 24 of the flying disc 22. The neck portion 114 of the flying disc attachment 100 is arched to avoid contact with the rim 26 of the flying disc 22. A user's hand 199 is shown gripping the flying disc 22 with the flying disc attachment 100 secured thereto as though preparing to throw the flying disc 22. This enables the user to perform various flying disc motions or actions with a disc they already own and are likely to use for other sporting purposes such as disc golf or Ultimate Frisbee, such as to exercise, stretch, or warm up for various flying disc sports or activities.

Figure 10:
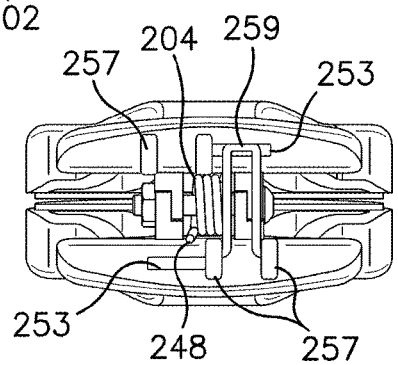
FIG. 10 is a rear elevational view of the weighted flying disc attachment as in FIG. 7.
Figure 11:
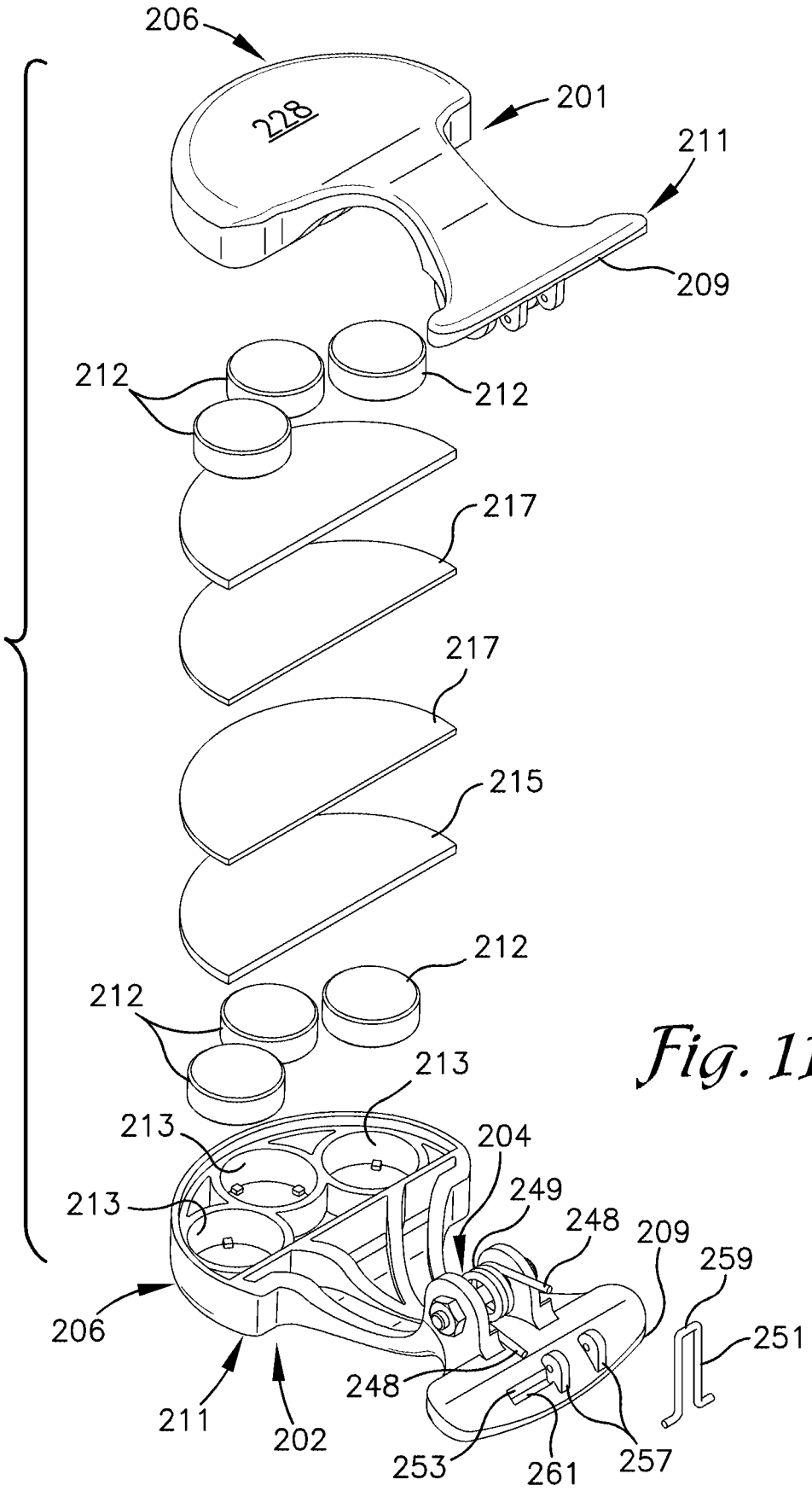
FIG. 11 is exploded, perspective view of the flying disc attachment as in FIG. 7.
Figure 12:
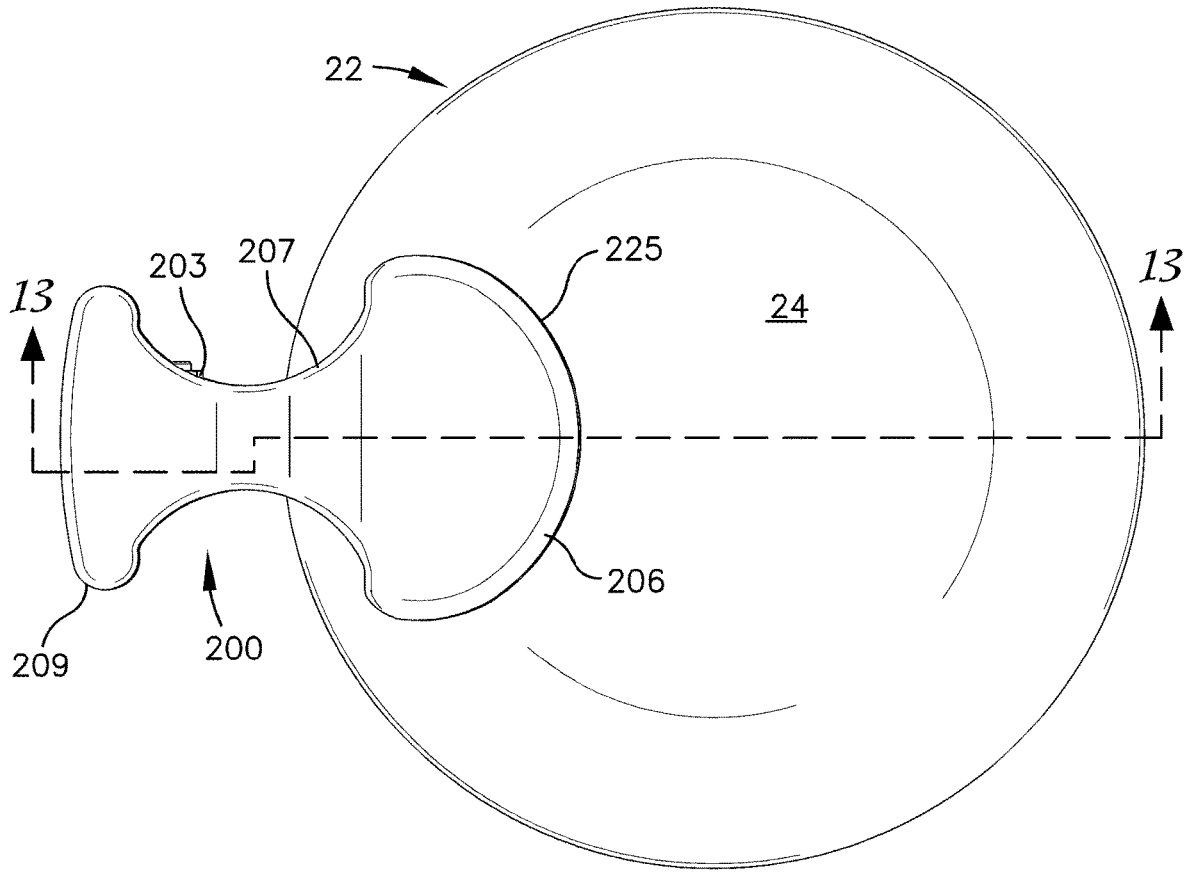
FIG. 12 is a top plan view showing the weighted flying disc attachment of FIG. 7 attached to a flying disc.
Figure 13:
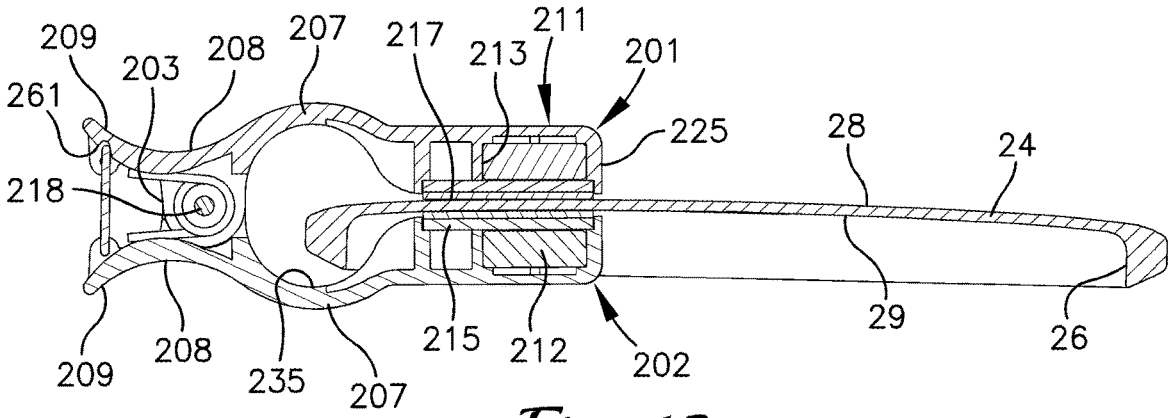
FIG. 13 is a cross-sectional view taken along line 13-13 of FIG. 12.

FIGS. 7-11 show an alternative embodiment of a flying disc attachment 200 which is shown attached to a flying disc 22 in FIGS. 12 and 13. Flying disc attachment 200 includes first and second clamping members 201 and 202 pivotally connected together by a hinge or hinge assembly 203 including a spring 204 which acts on and biases the first and second clamping members 201 and 202 together. In the embodiment shown, each clamping member 201 and 202 is weighted but it is to be understood that only one of the first and second clamping 201 and 202 members may be weighted.

Each of the clamping members 201 and 202 comprises a flight plate engaging member or grip head 206, a neck 207, a hinge portion 208 and a handle 209. In the embodiment shown in FIGS. 7-11, the clamping members 201 and 202 each are formed from a molded clamp member body 211 including the grip head 206, the neck 207, the hinge portion 208 and the handle 209. Each clamp member body 211 is preferably formed from a relatively rigid material such as a molded plastics or composite material and may be configured identically to allow each clamp member body 211 to be molded as a single part from a common mold cavity. The plastic utilized to form the clamp member body 211 may be one or more of polyethylene (PE), polypropylene (PP), polyethylene terephthalate (PETE), polyvinyl chloride (PVC), and acrylonitrile-butadiene-styrene (ABS) or other suitable plastics or plastic blends.

As best seen in FIG. 11, a plurality of cylindrical weights 212 are secured within weight receiving cavities or receivers 213 formed in the grip head 206 of each of the clamping members 201 and 202. In the embodiment shown, three cylindrical weights 212 are received in three receivers 213 formed in each of the grip heads 206. A covering layer or cover 215 is secured across the weight receiving cavities 213 in each of the grip heads 206 to secure or cover the weights 212 in the weight receiving cavities 213 and a grip portion or grip pad 217 formed from a layer of non-slip or slip resistant material is adhered to an outer face of the cover 215.

The hinge assembly 203 allows the first clamping member 201 to pivot relative to the second clamping member 202 about a hinge axis H. The hinge assembly 203 shown further comprises one or more hinge pins 218 and a spring element 204, such as a torsion spring, helical spring, leaf spring, banjo clip, an elastomer, or other such biasing spring element that biases first clamping member 201 relative to the second clamping member 202.

In the embodiment shown, the grip head 206 of each of the first and second clamping member 201 and 202 is enlarged relative to the neck 207 and is D-shaped. An outer peripheral edge 225 of each grip head 206 is rounded or curved and an inner peripheral edge 226, from which the neck 207 projects, is generally flat or straight. In the embodiment shown in FIGS. 7-11 an outwardly facing surface 228 of each grip head 206 is generally planar and encloses the weight receiving cavities 213. The outwardly facing surface of each grip head 206 provides a surface on which brand, sponsorship or promotional information or logos can be printed, formed on or otherwise applied thereto.

In the embodiment shown, the cover 215 of each grip head 206 is adhered to the grip head 206 to extend across an inwardly facing side 230 of the grip head 206 to cover the weight receiving cavities 213 and the weights 212 secured or positioned therein. The grip pads 217, attached to each cover 215 are configured and selected from a material to securely grip a flight plate 24 of a flying disc 22 when the flying disc attachment 200 is attached thereto. An outer facing surface or flight plate engaging face 232 of each grip pad 217 may be textured to more securely grip a face of the flight plate 24 of a flying disc 22. It is foreseen that the grip pad 217 may be formed as a plurality of gripping members secured to or formed on the cover 215 in the form of nubs or protrusions. The grip pads 217 may be made of rubber, gum rubber, silicone, foam, cork or a textured surface. Dycem™ brand non-slip materials have been found to be an effective material for use in forming the grip pads 217. The grip pads 217 may also be sprayed onto or over molded onto the cover 215 or an inwardly oriented face or surface of the portion of the clamp member body 211 forming the grip head 206. The cover 215 may also be made of a resilient material such as foam, rubber, gum rubber, silicone, cork to enhance the grip of the grip head 206 against a flight plate 24. It is also foreseen that the cover 215 could function as the grip pad 217 eliminating the need for an additional layer of material to form the grip pad 217.

The weight receiving cavities 213 are formed in each grip head 206 so as to extend inward from the inwardly facing side 230 of each grip head 206. In the embodiment shown, the cover 215 is adhered across the inwardly facing side 230 of the grip head 206 but it is foreseen that the cover 215 may be removably securable across the weight receiving cavities 213 to allow removal and replacement of the weights 212 secured therein. Such a configuration enables the user to insert a user-selectable weight 212 into one or more of the weight receiving cavities 213 to adjust the weight of the attachment 200 for different users, for different purposes, or for use with different flying discs.

Weights 212 in various embodiments may be formed from steel, tungsten, brass, plastic, or other suitable material. The weights 212 may be glued or otherwise fixedly secured in the weight receiving cavities 213. It is also foreseen that the weight 212 secured in each weight receiving cavity 213 could be formed from a plurality of weighted items such as ball bearings adhered together and secured in the receiver by a binder such as silicone or a resin. It is also foreseen that all or portions of the clamp member body 211 of one or both of the clamp members 201 and 202 could be formed from a material having a selected density to provide a desired or selected weight appropriate for use of the attachment 200 for training exercises. For example, the clamp member bodies 211 could be formed from a moldable composite material having a relatively dense filler or additive to provide the selected weight to form a weighted attachment 200 eliminating the need for forming weight receiving cavities 213 in the grip heads 206 which could then be formed as a solid part. It is also foreseen that only the portion of the clamp member body 211 forming the grip head 206 might be formed from the denser composite material.

Some examples of flying discs 22 as may be used with the embodiment of the flying disc attachment 200 of Figures have a flight plate 24 which is generally horizontally flat or slightly domed, with the rim 26 depending from an outer periphery of the flight plate 24. The neck portion 207 of each of the first and second clamping members 201 and 202 is configured to provide an opening or relief space 235 between the adjacent neck portions 207 when the flying disc attachment 200 is in the closed position to accommodate and protect a flying disc rim 26 received in the relief space 235 such that the rim 26 does not engage with the neck portion 114 and thereby prevent the grip pads 217 from engaging the flight plate 24 of the flying disc 22. In the embodiment shown, the neck portion of each of the first and second clamping members 201 and 202 project or curve outward from a plane extending between the grip heads 206 of the first and second clamping members 201 and 202 when biased together to form the relief space 235 between the adjacent neck portions 207. The relief space 235 is sized to receive the depending rim 26 of the flying disc 22 when the grip heads 206 are clamped onto the flight plate 24 of the flying disc. The relief or relief space 235 may be sized and configured to fit a specific model or type of flying disc 22, or as shown, may be sized and configured to accommodate a wide range of commercially available flying discs 22. The relief space 235 is preferably sufficiently wide and tall to receive the widest and tallest rim of a wide variety of commercially available flying discs 22.

The hinge assembly 203 of the flying disc attachment in this example is formed by overlapping pairs of hinge lobes or knuckles 241 formed on and projecting inward from an inner surface 243 of the hinge portion 208 of each of the first and second clamping members 201 and 202 connected together by hinge pin 218 extending through aligned holes (not show) formed though the hinge lobes 241. At least one of the first and second clamping members 201 and 202 are free to rotate about the pin 218, enabling the first and second clamping members 201 and 202 to move or pivot with respect to one another about the hinge axis H through hinge pin 218.

Figure 9:
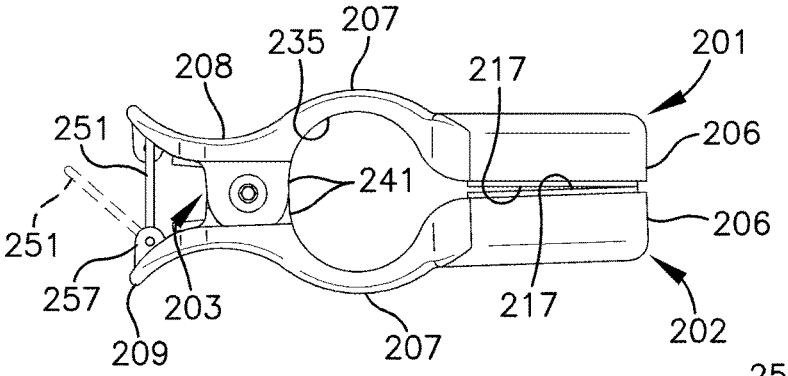
FIG. 9 is a right-side elevational view of the weighted flying disc attachment as in FIG. 7.

As best seen in FIG. 11, the spring or spring element 204 used to normally bias the grip heads 206 of the first and second clamping members 201 and 202 together is formed from a coiled spring wire with ends of the wire forming biasing elements or legs 248 projecting outward from a coiled section 249 of the spring wire at an acute angle. The spring 204 is positioned between adjacent sets of aligned hinge lobes 241 with the hinge pin 218 extending through the coiled section 249 of the spring 204 and the legs 248 of the spring 204 engaging an inner face of a respective hinge portion 208 or handle 209 of the first and second clamping members 201 and 202 rearward of the hinge pin 218 to normally bias the inwardly facing side 230 of each of the grip heads 206 toward each other. The spring 204 is captured in place by the hinge pin 218 running through the aligned holes 246 in both sets of overlapping hinge lobes 241 projecting inward from an inner surface of the hinge portion 208 of each of the first and second clamping members. As best seen in FIG. 9, the hinge portion 208 and hinge lobes 241 of each clamping member 201 and 202 are oriented relative to the respective grip head 206, such that the inwardly facing side 230 of each grip head 206 and the flight plate engaging face 232 of the grip pads 217 extend at an acute angle relative to each other when the grip pads 217 of the grip heads 206 are biased into engagement with each other, with grip pads 217 angling away from each other as they extend toward the hinge assembly 203. In a preferred embodiment, the angle formed between the grip pads 217 and inwardly facing side 230 of the grip heads 206 is between approximately one and ten degrees and in a preferred embodiment the angle is approximately two to three degrees. The angle is selected so that the flight plate engaging face 232 of the grip pads 217 on the first and second clamping members 201 and 202 extend approximately parallel to each other when clamped onto the flight plate 24 of a disc 22.

The handle 209 of each of the clamping members 201 and 202 of the flying disc attachment 200 is configured to be pinched or squeezed together to overcome the biasing force of the spring 204 and to pivot the grip heads 206 away from each other to cause separation of the grip heads 206. This facilitates attaching and detaching the flying disc attachment 200 to a flying disc. The handle 209 of each clamping member 201 and 202 is flared outward from an inner surface 243 of the hinge portion 208 or a plane extending across the flight plate engaging face 232 of the grip pad 217 and is formed wider than the neck 207 to facilitate gripping and squeezing the handles 209 toward each other. The handle 209 of each clamping member 201 and 202 is sized and configured to limit protrusion from a flying disc 22 when the flying disc attachment 200 is attached to the flying disc 22, and/or is contoured to generally follow the curved shape of flying disc 22.

Figure 8:
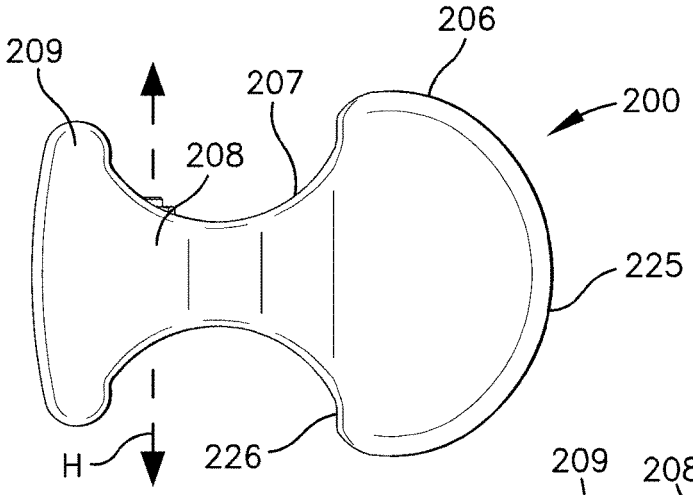
FIG. 8 is a top plan view of the weighted flying disc attachment as in FIG. 7.
Figure 7:
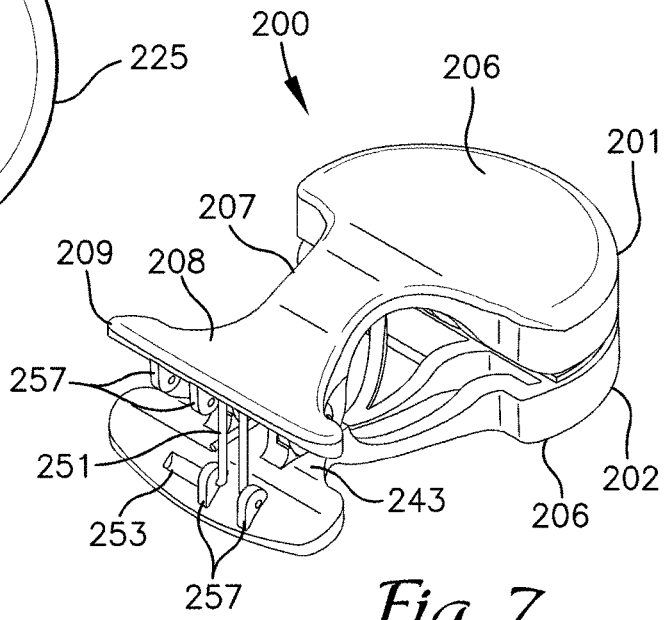
FIG. 7 is a perspective view of an alternative embodiment of a weighted flying disc attachment.

Referring to FIGS. 8, 10 and 11, a latch member 251 is pivotally mounted on the handle 209 of one of the first or second clamping members 201 and 202 and is pivotal into engagement with a latch member receiver 253 formed on the handle 209 of the other clamping member 201 or 202 to prevent the handles 209 from being pivoted toward each other and the grip heads 206 from being pivoted apart. In the embodiment shown, the latch member 251 is formed as from a U-shaped wire with outwardly projecting ends generally forming trunnions (not shown) which are rotatably mounted in pivot mounts 257 formed on and projecting inward from an inner surface of the handle 209 to which the latch member 251 is pivotally mounted. The latch member receiver 253 generally comprises a notch or recess formed in the handle 209 opposite the handle 209 to which the latch member 251 is pivotally mounted. The receiver 253 is aligned with the latch member 251 so that a distal end or cross bar 259 of the latch member 251 may be pivoted into the receiver 253 and advanced past a catch or ridge 261 at a front of the receiver 253 so that the distal end 259 of the latch member 251 may be pressed or snapped past the ridge 261 and held in place in the receiver 253. The latch member 251 preferably has a length which is selected to allow the distal end 259 of the latch member 251 to be pivoted into and snap into the receiver 253 past the catch 261 when the grip heads 206 are secured to and clamp against the flight plate 24 of most flying discs 22 with which the attachment 200 is adapted for use. Engagement of the latch member 251 on one handle 209 with the receiver on the other handle 209 prevents the grip heads 206 from pivoting apart thereby securing the attachment 200 to the flying disc 22. The distal end 259 of the latch member 251 may be manually pressed past the catch 261 and out of the receiver 253 before pressing the handles 209 together to remove the attachment 200 from a flying disc 200.

In the embodiment shown, in which the first and second clamp member bodies 211 are molded from a common mold, the handle 209 of each of the first and second clamping members 201 and 202 has a pair of pivot mounts 257 formed on and projecting inward from the inner surface of the handle 209 on one side of a centerline extending longitudinally through the handle 209 and a latch member receiver 253 formed in the inner surface of the handle 209 on the opposite side of the centerline through the handle 209 and adjacent the innermost pivot mount 257 for the latch member 251. Only a single latch member 251 is needed so only one set of pivot mounts 257 and one latch member receiver 253 is utilized.

Figure 14:
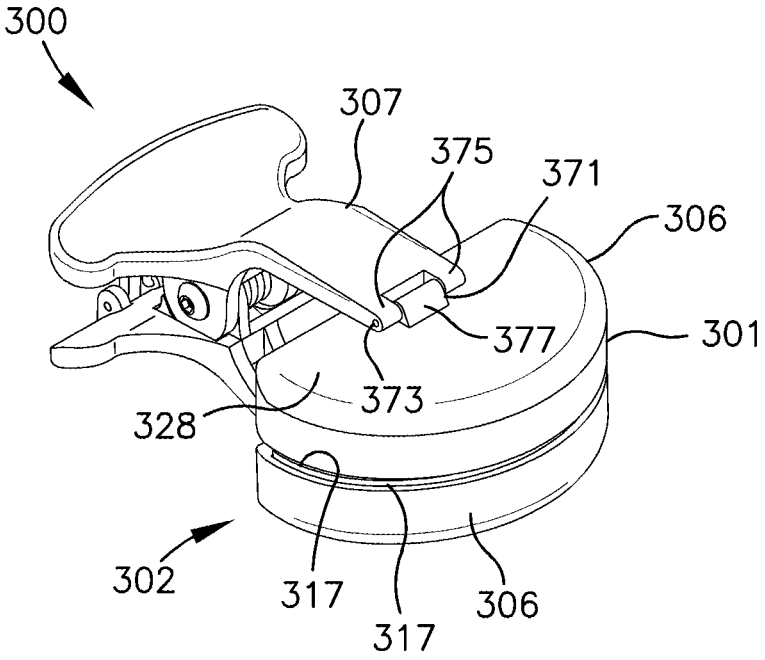
FIG. 14 is a perspective view of a further alternative embodiment of the weighted flying disc attachment in which a grip head is pivotally attached to a neck of a clamping member.

FIG. 14 shows an alternative embodiment of a flying disc attachment 300 constructed similar to the embodiment shown in FIGS. 7-12 except that a neck 307 of one or both of the clamping members 301 and 302 are pivotally connected to an outwardly facing surface 328 of the grip head 306 by a hinge assembly 371. The hinge assembly 371 shown comprises a hinge pin 373 extending through hinge knuckles 375 on the distal end of the neck 307 and an aligned hinge knuckle 377 formed on the grip head 306. The hinged or pivotal connection between the grip head 306 and the neck 307 will facilitate flush engagement of grip pads 317 of the grip heads 306 with the flight plate 24 of a flying disc 22 against which the grip heads 306 are clamped. It is foreseen that the grip heads 306 could be pivotally connected or flexibly connected to the neck portion by a variety of hinge means including a living hinge formed by forming a portion of the neck thinner than the rest of the neck.

A disc golf user may engage in a training session by choosing a flying disc 22 used for disc golf, and attaching the flying disc attachment 100 to the flying disc 22 as shown in FIG. 4 or attaching the flying disc attachment 200 to the flying disc 22 as shown in FIGS. 11 and 12. Flying disc attachment 300 may be attached in a manner similar to that shown for attachments 100 and 200 in FIGS. 4, 11 and 12. The user then proceeds to warm up by simulating a full throwing motion with the flying disc 22 repeatedly, varying the speed of the throwing motion and/or the weight in the flying disc attachments 100, 200 or 300 to achieve the desired type of exercise. In a further example, the user observes a bubble level or digital display coupled to the flying disc attachment indicating a degree of tilt from horizontal of the flight plate 24, and in another example observes a digital display indicating throwing speed, force, estimated distance, or other relevant training metrics. The user then completes several full throwing motions with a lower speed and full or extended throwing range to stretch, completing a training or exercise session.

The user later uses the same flying disc 22 and flying disc attachment 100, 200 or 300 to warm up before a round of disc golf, and to play a round of disc golf. The user again attaches the weighted flying disc attachment 100, 200 or 300 to the flying disc 22 as shown in FIG. 4 or 11 and 12 and proceeds to warm up and/or stretch using the weighted flying disc attachment 100, 200 or 300 before removing it and using the disc 22 to play a round of disc golf. In embodiments where the flying disc attachment 100, 200 or 300 provide an indication of level flight or other throwing dynamics, the user further observes these projected flight dynamics such as by reading a bubble level or digital display and can adjust or stretch as needed to obtain the desired throwing motion with the disc 22 that is to be used in the disc golf game.

The examples presented herein show how a weighted flying disc attachment 100, 200 or 300 can be used to exercise, stretch, or warm up for flying disc activities. The attachments 100, 200 or 300 shown include the construction of various elements of several examples of flying disc attachments. It also describes how in some examples a user-configurable weight can enable a user (or manufacturer) to change weights, such as for different purposes (such as exercise vs. warming up), for different users or different discs, or as the user's strength grows. Although specific embodiments have been illustrated and described herein, any arrangement that achieve the same purpose, structure, or function may be substituted for the specific embodiments shown. This application is intended to cover any adaptations or variations of the example embodiments of the invention described herein. These and other embodiments are within the scope of the following claims and their equivalents.

The invention claimed is:

1. A flying disc attachment for attachment to a flying disc having a flight plate and a depending rim, the flying disc attachment comprising:

a first clamp member;

a second clamp member;

a hinge mechanism connecting the first clamp member to the second clamp member, and operable to facilitate movement of the first clamp member with respect to the second clamp member while biasing the first clamp member with respect to the second clamp member;

one or more weights attached to at least one of the first clamp member and the second clamp member; and a grip coupled to at least one of the first clamp member and the second clamp member, the grip comprising a slip-resistant material and configured to engage a surface of the flying disc; wherein:

the one or more weights are secured within a cavity formed in a grip head of the at least one of the first clamp member and the second clamp member.

2. The flying disc attachment of claim 1, wherein the one or more weights are interchangeable.

3. The flying disc attachment of claim 1, wherein at least one of the first clamp member and the second clamp member are configured to avoid pinching the depending rim of the flying disc when the flying disc attachment is attached to the flying disc.

4. The flying disc attachment of claim 1, wherein the slip-resistant material of the grip comprises one or more of rubber, silicone, foam, cork, and a textured surface.

5. The flying disc attachment of claim 1 wherein the first clamp member comprises a first grip head and a first neck connecting the first grip head to the hinge mechanism and the second clamp member comprises a second grip head and a second neck connecting the second grip head to the hinge mechanism and wherein at least one of the first neck and the second neck projects outward from a plane extending between the first grip head and the second grip head when biased together to form a relief space between the first neck and the second neck sized to receive the depending rim of the flying disc when the first grip head and the second grip head are clamped onto the flight plate of the flying disc.

6. The flying disc attachment of claim 1 wherein the first clamp member comprises a first grip head and a first neck connecting the first grip head to the hinge mechanism and the second clamp member comprises a second grip head and a second neck connecting the second grip head to the hinge mechanism and wherein at least one of the first neck and the second neck are pivotably connected to the first grip head and the second grip head.

7. The flying disc attachment of claim 1 wherein the hinge mechanism includes a spring operable to bias the first clamp member toward the second clamp member.

8. The flying disc attachment as in claim 1 wherein a first flight plate engaging face of the first clamp member extends at an acute angle of between one and ten degrees relative to a second flight plate engaging face of the second clamp member when the first flight plate engaging face is biased into engagement with the second flight plate engaging face with the first flight plate engaging face and the second flight plate engaging face angling away from each other as they extend toward the hinge mechanism.

9. The flying disc attachment as in claim 1 wherein:

the first clamp member comprises a first grip head connected to a first hinge portion of the hinge mechanism which is connected to a first handle;

the second clamp member comprises a second grip head connected to a second hinge portion of the hinge mechanism which is connected to a second handle; and the first hinge portion and the second hinge portion are pivotally connected together and a spring, biasingly engaging the first clamp member and the second clamp member, normally biases the first grip head toward the second grip head and the first handle is manually pressable toward the second handle to overcome a biasing force of the spring to pivot the first grip head away from the second grip head; and wherein:

the flying disc attachment further comprises a latch member selectively positionable to engage the first handle and the second handle to prevent compression of the first handle toward the second handle and prevent the first grip head from pivoting away from the second grip head.

10. The flying disc attachment as in claim 1 further comprising:

a first cavity formed in the at least one of the first clamp member and the second clamp member; and wherein the one or more weights comprises at least a first weight secured within the first cavity.

11. The flying disc attachment as in claim 10 wherein the first cavity is formed in an inwardly facing side of the at least one of the first clamp member and the second clamp member and a cover with the grip secured thereon is secured over the first cavity.

12. The flying disc attachment as in claim 1 further comprising:

a first cavity formed in the first clamp member and a second cavity formed in the second clamp member; and the one or more weights comprises at least a first weight secured within the first cavity and at least a second weight secured within the second cavity.

13. The flying disc attachment as in claim 12 wherein the grip comprises a first grip and a second grip and the first cavity is formed in an inwardly facing side of the first clamp member and a first cover is secured over the first cavity and the first grip is secured on an outer surface of the first cover and the second cavity is formed in an inwardly facing side of the second clamp member and a second cover is secured over the second cavity and the second grip is secured on an outer surface the second cover.

14. A method of using a flying disc attachment with a flying disc having a flight plate and a depending rim extending around an outer periphery of the flight plate, comprising:

attaching a removable flying disc attachment to the flying disc by causing an upper piece and a lower piece of the flying disc attachment to grip a portion of the flying disc, the flying disc attachment comprising one or more weights secured within a cavity formed in a grip head of at least one of the upper piece and the lower piece;

at least one of stretching or warming up a flying disc user's body by simulating a throwing motion using the flying disc with the removable flying disc attachment attached thereto; and removing the removable flying disc attachment from the flying disc prior to throwing the flying disc.

15. The method of using the flying disc attachment as in claim 14 wherein causing the upper piece and the lower piece of the flying disc attachment to grip the portion of the flying disc comprises causing the upper piece and the lower piece to clamp onto the flight plate of the flying disc.

16. The method of using the flying disc attachment of claim 14, wherein the one or more weights are removeable from the flying disc attachment and replaceable with one or more additional weights.

17. The method of using the flying disc attachment of claim 14, further comprising displaying one or more indications of position or motion of the flying disc attachment to a user with an indicator that provides an indication of level flight or other throwing dynamics.

18. A flying disc attachment for attachment to a flying disc having a flight plate and a depending rim, the flying disc attachment comprising:

a first clamp member including a first grip head, a first neck portion, a first hinge portion and a first handle, the first neck portion connecting the first grip head to the first hinge portion;

a second clamp member including a second grip head, a second neck portion, a second hinge portion and a second handle, the second neck portion connecting the second grip head to the second hinge portion;

the first hinge portion pivotally connected to the second hinge portion such that the first grip head and the first neck portion connected thereto are pivotable about a hinge axis and relative to the second grip head and the second neck portion connected thereto;

a spring on the flying disc attachment biasing the first grip head toward the second grip head;

one or more weights secured within a first cavity formed in at least one of the first grip head of the first clamp member and the second grip head of the second clamp member; and the first handle and the second handle are engageable by a user to pivot the first grip head and the first neck portion connected thereto against a biasing force of the spring, about the hinge axis and away from the second grip head and the second neck portion connected thereto; wherein:

at least the second neck portion projects outward from a plane extending between the first grip head and the second grip head when biased together to form a relief space between first and second neck portions, the relief space sized to receive the depending rim of the flying disc when the first grip head and the second grip head are clamped onto the flight plate of the flying disc, and the first grip head includes a first flight plate engaging face and the second grip head includes a second flight plate engaging face, and the first flight plate engaging face and the second flight plate engaging face each engage an opposite surface of the flying disc when the first grip head and the second grip head are clamped onto the flight plate of the flying disc.

19. The flying disc attachment of claim 18 wherein the first grip head and the second grip head are weighted.

20. The flying disc attachment as in claim 18 wherein at least one first weight is secured to the first grip head.

21. The flying disc attachment as in claim 20 wherein at least one second weight is secured to the second grip head.

22. The flying disc attachment as in claim 18 wherein at least one of the first neck portion and the second neck portion are pivotably connected to the first grip head and the second grip head respectively.

23. The flying disc attachment as in claim 18 further comprising a latch member selectively positionable to engage the first handle and the second handle to prevent pivoting of the first grip head away from the second grip head.

24. The flying disc attachment as in claim 18 wherein:

the first neck portion and the second neck portion project outward from the plane extending between the first grip head and the second grip head when biased together to form the relief space between the first and second neck portions, the relief space sized to receive the depending rim of the flying disc when the first grip head and the second grip head are clamped onto the flight plate of the flying disc.

25. The flying disc attachment as in claim 18 wherein the first flight plate engaging face of the first grip head extends at an acute angle of between one and ten degrees relative to the second flight plate engaging face of the second grip head when the first flight plate engaging face is biased into engagement with the second flight plate engaging face with the first flight plate engaging face and the second flight plate engaging face angling away from each other as they extend toward the first hinge portion and the second hinge portion.

26. The flying disc attachment as in claim 18 wherein the one or more weights comprises at least a first weight secured within the first cavity.

27. The flying disc attachment as in claim 26 wherein the first cavity is formed in an inwardly facing side of at least one of the first clamp member and the second clamp member and a cover with a grip secured thereon is secured over the first cavity, the grip comprising a slip-resistant material and configured to engage a surface of the flying disc.

28. The flying disc attachment as in claim 18 further comprising:

a second cavity formed in the second clamp member; and the one or more weights comprise at least a first weight secured within the first cavity and at least a second weight secured within the second cavity.

29. The flying disc attachment as in claim 28 wherein the first cavity is formed in an inwardly facing side of the first clamp member and a first cover is secured over the first cavity and a first grip comprising a slip-resistant material configured to engage a surface of the flying disc is secured on an outer surface of the first cover and the second cavity is formed in an inwardly facing side of the second clamp member and a second cover is secured over the second cavity and a second grip comprising a slip-resistant material configured to engage a surface of the flying disc is secured on an outer surface the second cover.

* * * * *